US008251078B2

(12) United States Patent
Ma

(10) Patent No.: US 8,251,078 B2
(45) Date of Patent: Aug. 28, 2012

(54) UMBRELLA HANDLE

(76) Inventor: Oliver Joen-an Ma, Arcadia, CA (US)

( * ) Notice: Subject to any disclaimer, the term of this patent is extended or adjusted under 35 U.S.C. 154(b) by 87 days.

(21) Appl. No.: 12/431,710

(22) Filed: Apr. 28, 2009

(65) Prior Publication Data

US 2010/0269871 A1 Oct. 28, 2010

(51) Int. Cl.
*A45B 25/14* (2006.01)

(52) U.S. Cl. ..... 135/37

(58) Field of Classification Search ..... 135/15.1, 135/98, 37, 20.3; 188/67, 72.7, 206; 248/122.1, 248/125.1, 157, 219.3, 230.2, 229.11, 161, 248/412, 188.5
See application file for complete search history.

(56) References Cited

U.S. PATENT DOCUMENTS

| | | | | |
|---|---|---|---|---|
| 1,630,870 | A * | 5/1927 | Strunck | 248/412 |
| 2,584,283 | A | 2/1952 | Masoner | |
| 2,709,059 | A * | 5/1955 | Lear et al. | 248/178.1 |
| 2,762,243 | A * | 9/1956 | Knosp et al. | 408/236 |
| 3,787,137 | A * | 1/1974 | Renner | 408/241 R |
| 3,828,805 | A | 8/1974 | Thur | |
| 3,924,834 | A | 12/1975 | Young | |
| 4,084,600 | A * | 4/1978 | dePolo | 135/15.1 |
| 4,119,290 | A | 10/1978 | Gies | |
| 4,259,974 | A * | 4/1981 | de Polo | 135/24 |
| 4,650,145 | A | 3/1987 | Natzel et al. | |
| 4,720,071 | A | 1/1988 | Nelson et al. | |
| 4,823,821 | A | 4/1989 | Day | |
| 4,925,142 | A | 5/1990 | Farmer | |
| H906 | H | 4/1991 | Baggett et al. | |
| 5,186,570 | A | 2/1993 | Graf | |
| 5,213,122 | A | 5/1993 | Grady, II | |
| 5,224,505 | A | 7/1993 | Wu | |
| 5,232,304 | A | 8/1993 | Huang | |
| 5,329,953 | A | 7/1994 | Becher | |
| 5,385,323 | A * | 1/1995 | Garelick | 248/161 |
| 5,483,985 | A | 1/1996 | Yu | |
| 5,575,527 | A | 11/1996 | Pfister | |
| 5,632,464 | A | 5/1997 | Aberle | |
| 5,746,152 | A * | 5/1998 | Huse | 114/363 |
| 5,752,534 | A | 5/1998 | Becher | |
| 5,782,256 | A | 7/1998 | Bradley | |

(Continued)

FOREIGN PATENT DOCUMENTS

AU 702172 2/1999

(Continued)

OTHER PUBLICATIONS

European Extended Search Report regarding European Patent Application No. 10250845.4, dated Sep. 6, 2010 in 6 pages.

*Primary Examiner* — Noah Chandler Hawk
(74) *Attorney, Agent, or Firm* — Knobbe Martens Olson & Bear, LLP

(57) ABSTRACT

Umbrella handle assemblies are provided for maintaining a position of a canopy relative to a support pole of an umbrella. The handle assemblies can be slidable along the pole, but can also be actuated to cause the assemblies to be generally fixed at a given longitudinal position along the pole in order to maintain an open or closed position of the canopy. The handle assemblies can include a handle that can be actuated to cause a brake component of the assemblies to engage with the pole to secure the handle assembly relative to the pole.

40 Claims, 10 Drawing Sheets

U.S. PATENT DOCUMENTS

| | | | | |
|---|---|---|---|---|
| 5,882,077 | A | 3/1999 | Gebhard | |
| 6,082,383 | A | 7/2000 | Wilson | |
| 6,092,771 | A | 7/2000 | Fich | |
| 6,443,406 | B1 * | 9/2002 | Frank | 248/125.8 |
| 6,543,464 | B1 | 4/2003 | Grady, II | |
| 6,820,847 | B2 | 11/2004 | Camarota et al. | |
| 6,948,283 | B2 | 9/2005 | Burkart et al. | |
| 7,350,532 | B2 | 4/2008 | Wu | |
| 7,380,563 | B2 | 6/2008 | Seo | |
| 7,628,164 | B2 | 12/2009 | Ma | |
| 2005/0268952 | A1 | 12/2005 | Ma | |
| 2006/0090784 | A1 | 5/2006 | Ma | |
| 2006/0151018 | A1 | 7/2006 | Wilson | |

FOREIGN PATENT DOCUMENTS

| | | |
|---|---|---|
| DE | 580503 | 7/1933 |
| DE | 20306406 | 7/2003 |
| EP | 1654952 | 5/2006 |
| FR | 2687714 A1 | 8/1993 |
| JP | 5-31003 | 2/1993 |
| NL | 9500219 | 9/1996 |

* cited by examiner

UMBRELLA HANDLE

BACKGROUND

1. Field of the Inventions

The present inventions relate to umbrellas, and more specifically, to an umbrella having an umbrella handle that can be actuated to provide frictional engagement with an umbrella pole to maintain a canopy of the umbrella in a given position.

2. Description of the Related Art

The use of umbrella shade structures generally requires that a canopy member be opened to provide shade over a given area. In many of these structures, the canopy may be attached to a moveable assembly of the structure. When the assembly is moved from a closed to an open position, the canopy can be deployed to thereby provide shade. Likewise, the canopy can be stowed when the assembly is retracted to the closed position.

Umbrellas provide a relatively simple moveable assembly that is coupled with a canopy. The movable assembly is attached to a center pole and, in some cases, will have a sliding component that moves along the pole to allow the assembly to be moved between open and closed positions. When the assembly is moved to the open position, the weight of the canopy and the assembly itself can exert a closing force on the assembly that urges the assembly to the closed position.

In order to counteract the closing force on the umbrella, the umbrella may incorporate a latch pin to maintain the assembly and the canopy in the open position. The latch pin, when engaged, can keep the umbrella open.

SUMMARY

An aspect of at least one of the embodiments disclosed herein is the realization that an umbrella can be improved to more securely maintain a canopy thereof in an open or closed position. Further, in accordance with another aspect is the realization that an umbrella handle assembly can be configured to provide superior alignment of each of the components thereof in order to minimize drag or contact between the umbrella pole and the assembly when the assembly is being moved along the pole. Furthermore, it is contemplated that superior alignment of the components of the handle assembly with the pole can enhance the frictional engagement between the assembly and the pole.

In particular, some embodiments of the handle assembly can be configured to be cooperatively connected with the canopy in order to open and close the canopy. The handle assembly can slide up and down the pole to open or close the canopy. Additionally, the handle assembly can comprise a handle that moves to directly or indirectly actuate a brake component of the assembly to cause the brake component to engage or disengage the pole or fixed structure to cause the assembly to be free to move or generally fixed relative to the pole.

In some embodiments, the handle can be rotated to cause a wedge component to cause the brake component to engage or disengage the pole coupled therewith. For example, the wedge component can move within a wedge recess of the brake component to cause the brake component to expand or contract in response to movement of the handle.

Further, the brake component can be precisely directly or indirectly supported and aligned to reduce the contact between the brake component when not actuated to engage the pole, and to maximize the contact between the brake component and the pole when actuated to engage the pole.

For example, a handle assembly can be provided that includes a handle having a threaded shaft that extends from the handle and into an interior section of an umbrella pole. The shaft can be threadably coupled to a brake component of the handle assembly. When the handle is rotated, the threaded shaft can rotate relative to the brake component and cause the brake component to move within the interior section of the umbrella pole (transversely to the longitudinal axis of the pole). This transverse movement of the brake mechanism can allow a portion of the umbrella pole to be pinched or squeezed between the handle and the brake mechanism. In other words, with a given amount of rotation, the handle can cause the brake mechanism to frictionally engage the interior section of the umbrella pole. As noted above, the handle assembly can be used to open or close the umbrella canopy. In this regard, the handle assembly can be operative to be fixed or locked at a given longitudinal position or elevation along the umbrella pole. Thus, the umbrella canopy can be maintained in an open or closed state.

More particularly, an umbrella handle assembly can be provided that uses an expandable wedge brake mechanism. The brake mechanism can include a wedge component and a brake component. The wedge component can be rotatably and translationally engaged with a threaded shaft of a handle of the handle assembly. Further, the brake component can include wedge-shaped surfaces that mate with corresponding wedge-shaped surfaces of the wedge component. As such, when the wedge component is moved as a result of rotation of the handle, the wedge-shaped surfaces of the brake component and the wedge component can interact to cause the brake component to expand within and contact the interior section of the umbrella pole. Accordingly, the brake mechanism can expand to contact a large surface area of the interior section of the umbrella pole and to contact the interior section of the pole at multiple locations, thus enhancing the frictional engagement of the brake mechanism with the interior section of the umbrella pole. Accordingly, such embodiments can provide significant functional advantages.

In accordance with an embodiment, an umbrella handle assembly is provided for maintaining a position of a canopy relative to a support pole of an umbrella. The umbrella handle assembly can be slidably disposed on the support pole. The umbrella handle assembly can comprise a handle component, a transmission component, a brake component, and a wedge component.

The handle component can have a grip portion and a connector portion. The handle component can be configured to transfer motion of the grip portion to the connector portion. The transmission component can have a first end and a second end. The first end can be coupled to the connector portion of the handle component. The second end can be configured to extend at least partially through a perimeter of the support pole.

The brake component can have at least one contact surface and at least one engagement surface. The engagement surface can be configured to contact an engagement surface of the support pole. Further, the wedge component can have at least one contact surface that is slidably positioned against the contact surface of the brake component and that is moveable relative to the brake component. The wedge component can be interconnected with the transmission component such that movement of the transmission component causes the wedge component to move relative to the brake component. The movement of the wedge component can cause the engagement surface of the brake component to engage or disengage with the engagement surface of the support pole.

In some implementations, the brake component can comprise a pair of contact surfaces for slidably contacting a pair of contact surfaces of the wedge component. Further, the pair of contact surfaces can be configured in a wedge formation and the pair of contact surfaces of the wedge component can slidably contact the contact surfaces of the brake component.

The transmission component can be a generally elongate shaft having a threaded portion adjacent to the second end thereof. The threaded portion can be threadably coupled to the wedge component such that rotation of the transmission component causes translation of the contact surface of the wedge component against the contact surface of the brake component. Further, rotation of the handle component can cause the wedge component to be drawn toward the first end of the transmission component.

The brake component can be configured to define a wedge-shaped recess that is defined at least partially by a pair of opposing contact surfaces. The wedge component can be slidably disposed within the recess of the brake component with each a pair of contact surfaces contacting a respective one of the opposing contact surfaces. In this regard, movement of the handle portion can cause the wedge component to move within the wedge recess to cause the brake component to engage or disengage with the engagement surface of the support pole. In some embodiments, the brake component can comprise a plurality of engagement surfaces.

The wedge-shaped recess of the brake component can extend generally parallel relative to a longitudinal axis of the support pole. Further, the wedge component can be configured to move in a first direction upon actuation by the handle component and the movement of the wedge component can cause the brake component to move in a direction transverse to the first direction. In some implementations, the first direction can be linear. Further, the first direction can be generally perpendicular relative to a longitudinal axis of the support pole.

In accordance with another embodiment, an umbrella handle assembly is provided for maintaining a position of a canopy relative to a support pole of an umbrella. The umbrella handle assembly can be slidably disposed on the support pole. The umbrella handle assembly can comprise a brake component, a wedge component, and a handle component. The brake component can be disposed within the support pole. The handle component can be interconnected with the wedge component for drawing the wedge component into a wedge-shaped recess of the brake component to cause the brake component to expand against and engage with an engagement surface of the umbrella pole to thereby secure the umbrella handle assembly relative to the umbrella pole.

In some implementations, the wedge-shaped recess of the brake component can extend generally parallel relative to a longitudinal axis of the support pole. The handle assembly can further comprise a transmission component that interconnects the handle component with the wedge component. The transmission component can be a generally elongate shaft having a threaded portion that is threadably coupled to the wedge component such that rotation of the transmission component causes translation of the wedge component within the recess of the brake component. In this regard, rotation of the handle component can cause the wedge component to be drawn toward the first end of the transmission component.

Further, the wedge component can be configured to move in a first direction upon actuation by the handle component and the movement of the wedge component can cause the brake component to move in a direction transverse to the first direction. In some implementations, the first direction can be linear. Additionally, the first direction can be generally perpendicular relative to a longitudinal axis of the support pole.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION

Figure 1A:
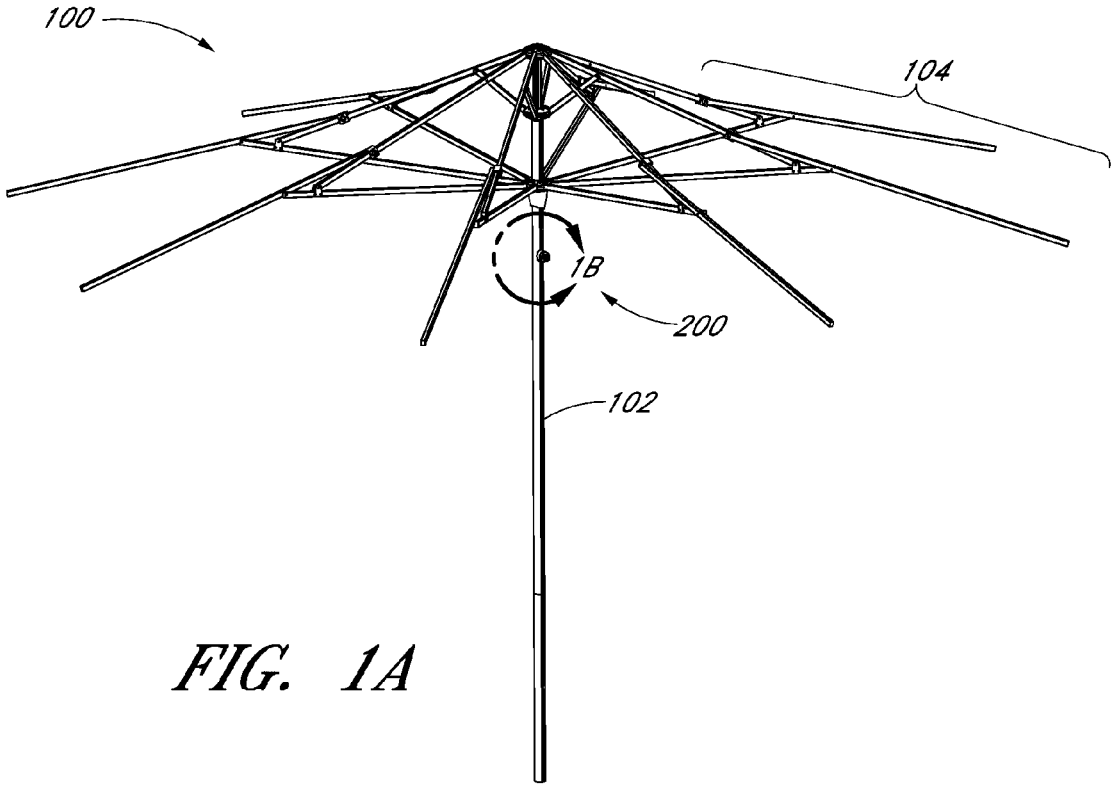
FIG. 1A is a perspective view of an umbrella, according to an embodiment of the present inventions.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Many of the embodiments encompassed by the disclosure herein can provide for an improved umbrella handle assembly. The umbrella handle assembly can be operative to move up and down an umbrella pole, which movement can serve to open and close an umbrella canopy. For example, the handle assembly can be operatively coupled to the umbrella canopy to control the opening and closing thereof. Thus, in some embodiments, as the handle assembly moves up, the canopy can move to an open position, and as the assembly moves down, the canopy can move to a closed position. Further, the handle assembly can also be used to fix the canopy in an open or closed position. For example, a handle of the handle assembly can be rotated in order to lock the handle assembly (and canopy) in a given position.

One of the primary benefits of embodiment of the handle assembly is the ease of use. For example, in some embodiments, a user need only rotate a knob of the assembly to fully engage or fully disengage the handle assembly in order to move the umbrella canopy to an open or closed position or to fix the canopy in an open or closed position. Additionally, some embodiments can be configured to create an interference or press fit against the umbrella pole by compressing a portion of the assembly against the pole. In some embodiments, the compression can be achieved through expansion. Thus, the handle assembly can be used to very stably and reliably maintain the canopy in an open or closed position.

In this regard, it is contemplated that in some embodiments, the handle assembly can comprise one or more components that move directly as a result of turning the handle in a clockwise or counterclockwise movement. However, the handle assembly can also comprise other components that are affected or actuated indirectly by movement of the handle. In some embodiments, this can produce a mechanical advantage or efficiency. For example, in some embodiments, an indirectly moved component can be drawn toward or away from the handle of the assembly. The movement of such a component can be in any variety of directions. For example, if the handle assembly rotates about an axis of rotation, the indirectly actuated component can translate along the axis in response to rotation of the handle. In an embodiment, the indirectly actuated component can be brought into frictional contact with the support pole in order to fix the position of the handle assembly along the support pole. In some embodiments, the frictional contact can be achieved through compression of a resilient material against the support pole.

In other embodiments, other indirectly actuated components can be employed to facilitate engagement of the handle assembly with the support pole, for example, to more securely maintain the canopy in an open or closed position. In this regard, it is contemplated that a first indirectly actuated component can interact with additional indirectly actuated components in order to cause engagement with the support pole. For example, a wedge-shaped component can be indirectly actuated by rotation of the handle, and the wedge-shaped component can cause separation or expansion of another indirectly actuated component in order to cause such component to frictionally engage the support pole. In some embodiments such an expansion component can be disposed interiorly to the support pole.

For example, a handle assembly can include a handle having a threaded shaft that extends from the handle and into an interior section of an umbrella pole. The shaft can be in mechanical communication with a brake mechanism of the handle assembly. For example, when the handle is rotated, the shaft can rotate relative to the brake mechanism and cause a portion of the handle assembly to move and can cause a portion of the brake mechanism to engage the umbrella pole. In some embodiments, with a given amount of rotation, the handle can cause the brake mechanism to frictionally the engage an interior section of the umbrella pole. As noted above, the handle assembly can be used to open or close the umbrella canopy. In this regard, the handle assembly can be fixed or locked at a given longitudinal position or elevation along the umbrella pole to maintain the umbrella canopy in an open or closed state.

More particularly, an umbrella handle assembly can be provided that uses an expandable wedge brake mechanism. The brake mechanism can include a wedge component and a brake component. The wedge component can be threadably and rotatably engaged with a threaded shaft of a handle of the handle assembly. Further, the brake component can include contact surfaces that mate with corresponding contact surfaces of the wedge component. The wedge component can be moved as a result of rotation of the handle, to cause contact between the contact surfaces of the brake component and the contact surfaces of the wedge component. In some embodiments, this contact can cause the brake component to expand within and engage with an interior section of the umbrella pole. Accordingly, the brake mechanism can expand or deflect to engage the interior section of the umbrella pole. In some embodiments, engagement surfaces of the brake mechanism can continue to be urged or compressed against the pole with continued actuation of the handle, thus enhancing the frictional engagement of the brake mechanism with the interior section of the umbrella pole. Accordingly, such embodiments can provide significant functional advantages.

Figure 1B:
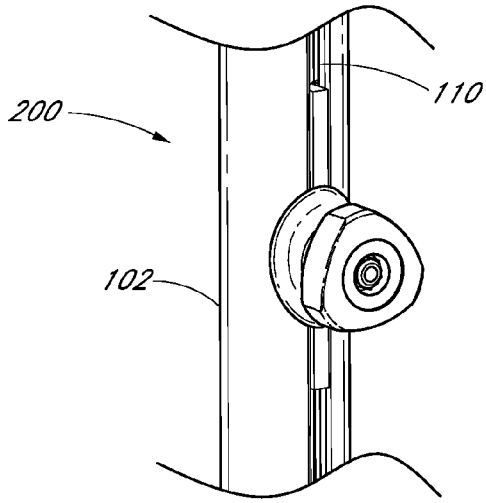
FIG. 1B is an enlarged perspective view of a handle assembly of the umbrella of FIG. 1A, according to an embodiment.

FIG. 1A is a perspective view of an umbrella 100, according to an embodiment of the present inventions. As illustrated, the umbrella 100 can comprise a support pole 102, an umbrella canopy support frame 104, and an umbrella handle assembly 200. FIG. 1B is an enlarged perspective view of the handle assembly 200 of the umbrella 100 of FIG. 1A, according to an embodiment. As shown in FIG. 1B, the support pole 102 of the umbrella 100 can comprise a longitudinal slot 110 along which the handle assembly 200 can travel. As such, the handle assembly 200 can be at least partially disposed within an interior section of the support pole 102. In some embodiments, the handle assembly 200 can comprise one or more portions that are disposed within an interior of the support pole 102.

Figure 2:
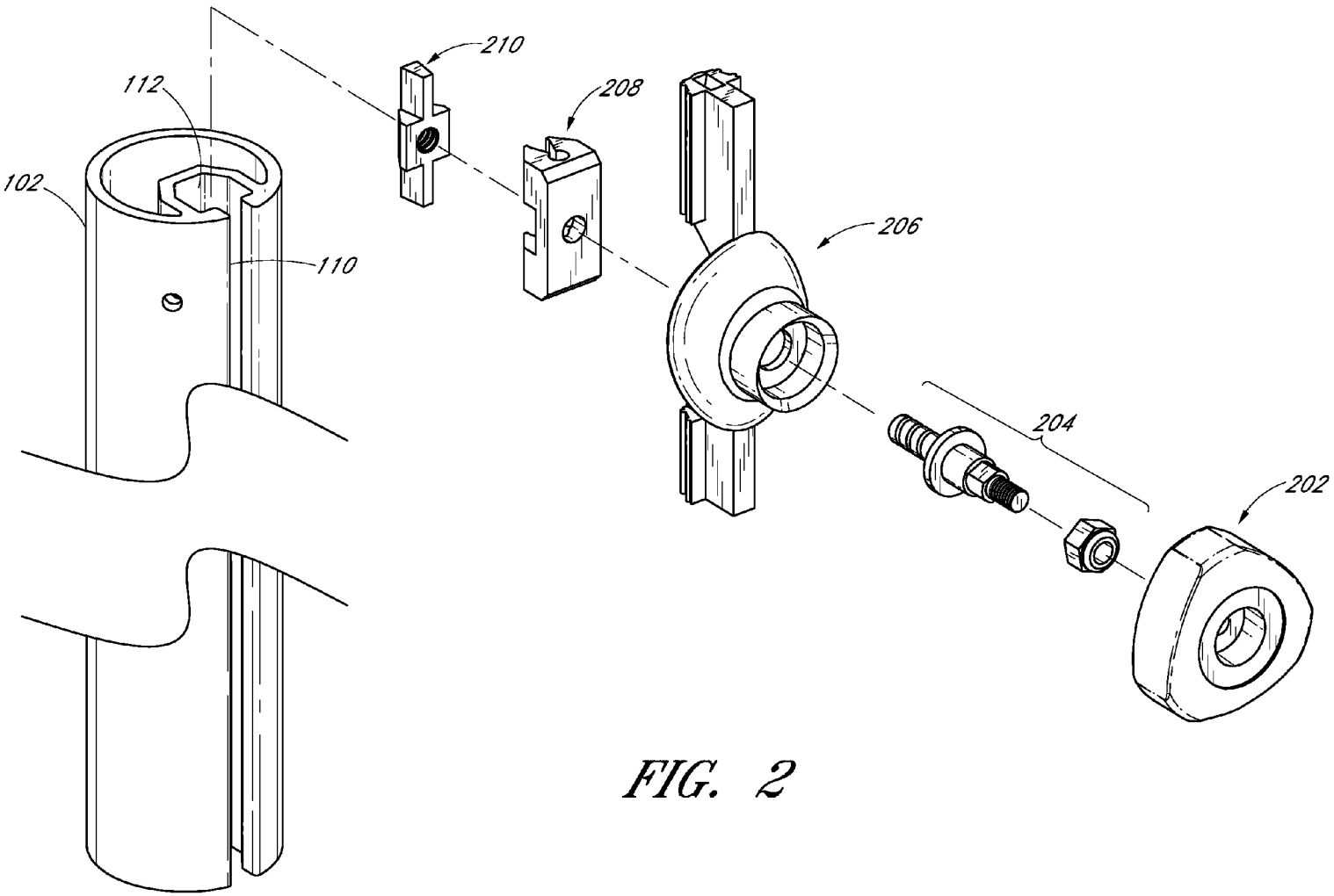
FIG. 2 is an exploded view of the handle assembly of FIG. 1B.

FIG. 2 illustrates an exploded view of the handle assembly 200 shown in FIG. 1B, as well as a cross-sectional top perspective view of the support pole 102. The longitudinal slot 110 can extend inwardly toward a center of the pole 102. The slot 110 can be enclosed within a cavity or recess 112 of the pole 102. In such embodiments, the recess 112 can occupy only a portion of the interior volume or space of the pole 102. However, other embodiments are contemplated wherein the recess 112 is formed by a greater or entire portion of the interior of the pole 102. Further, it is also contemplated that poles having various other cross-sectional designs can also be used. For example, depending on the actuation or gripping mechanism of the handle assembly, the pole can be cylindrical, planar, or other geometric shapes.

The handle assembly 200 can comprise a handle 202, a transmission component 204, a slider component 206, a brake component 208, and a wedge component 210. When interconnected, the transmission component 204 can extend through the slider component 206 and engage with the handle 202 on a proximal end thereof and with the wedge component 210 on a distal end thereof. In this regard, the handle 202 can be rotationally and axially fixed onto the slider component 206. However, in some embodiments, it is contemplated that the wedge component 210 can be configured with a reverse thread that interacts with threads disposed on the distal end of the transmission component 204. In this regard, the transmission component 204 can comprise a minor thread for connection with the handle 202 and a major thread for connection with the wedge component 210.

Figure 3B:
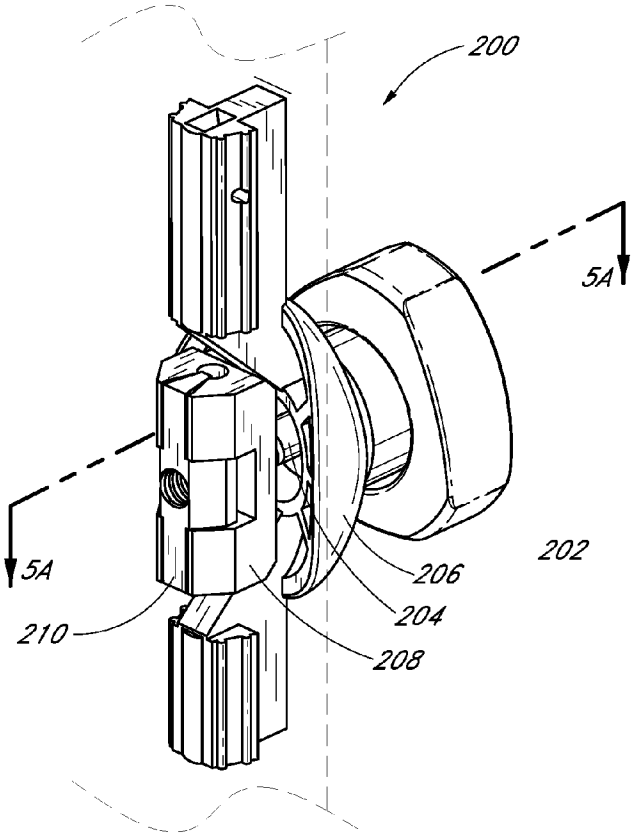
FIG. 3B is a rear perspective view of the handle assembly of FIG. 1B.
Figure 3A:
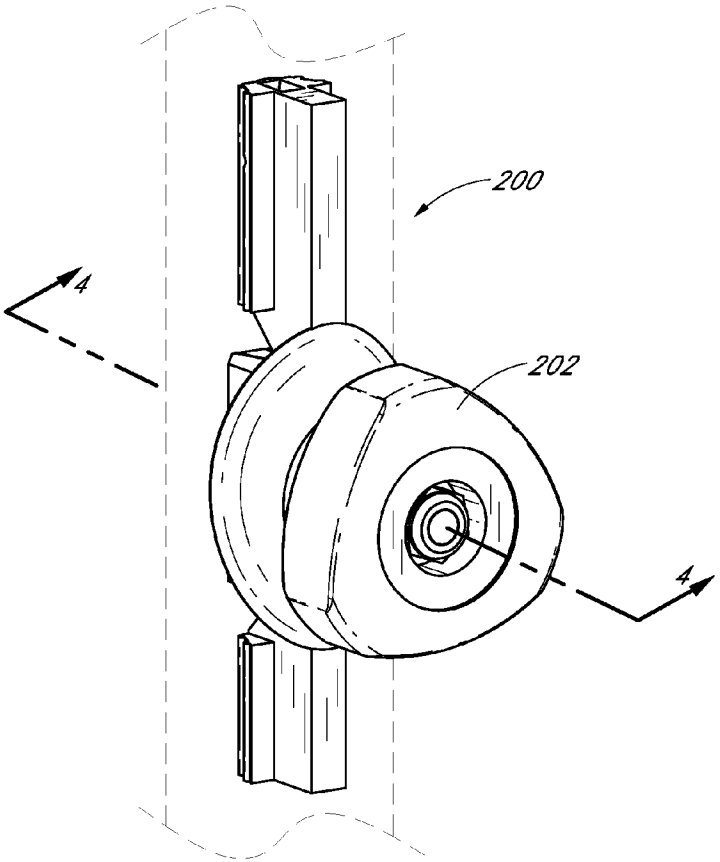
FIG. 3A is a front perspective view of the handle assembly of FIG. 1B.

FIG. 3A is a front perspective view of the handle assembly of FIG. 1B. Further, FIG. 3B is a rear perspective view of the handle assembly of FIG. 1B. In both of these figures, the support pole 102 has been shown in hidden lines. As noted above, the assembly 200 comprises the handle 202, the transmission component 204, the slider component 206, the brake component 208, and the wedge component 210. FIGS. 4A-8B illustrate embodiments of the handle 202, the transmission component 204, the slider component 206, the brake component 208, and the wedge component 210.

Figure 4B:
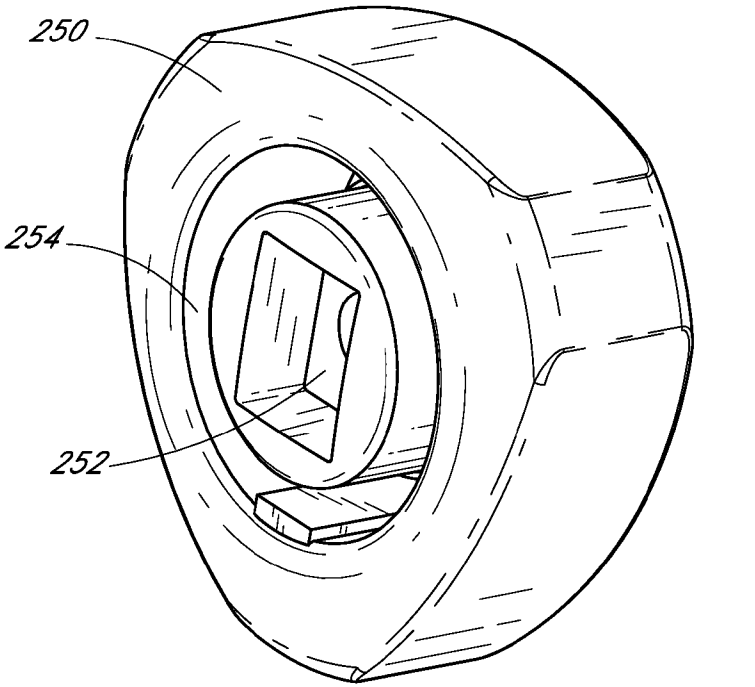
FIG. 4B is a rear perspective view of the handle component shown in FIG. 4A.
Figure 4A:
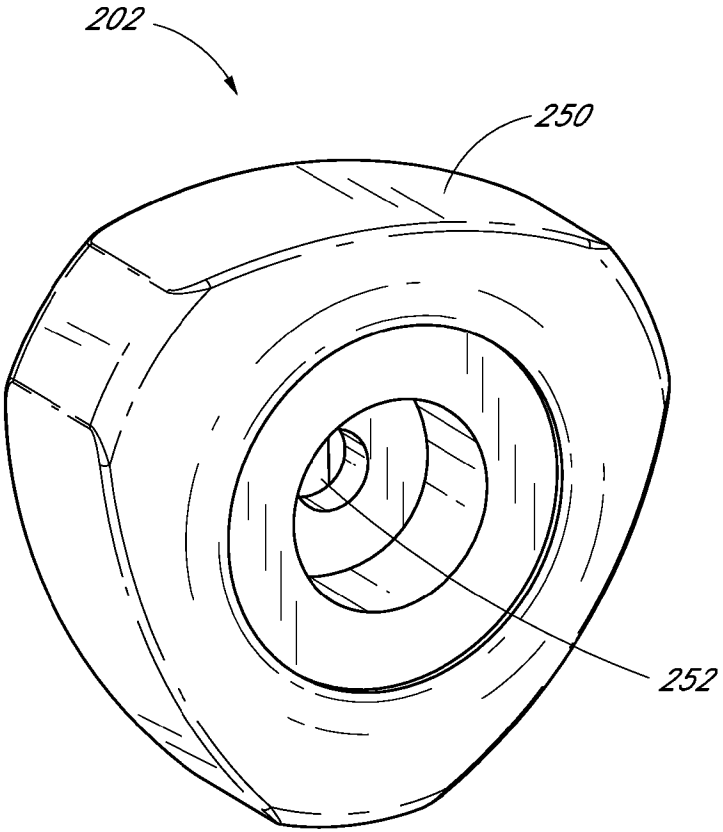
FIG. 4A is a front perspective view of a handle component of the handle assembly, according to an embodiment.

FIGS. 4A-B illustrate an embodiment of the handle 202. As shown, the handle 202 can comprise a user-graspable body section 250 and an engagement section 252. In the illustrated embodiment, the handle 202 is configured to allow the user to provide a rotational force to the transmission component 204. In some embodiments, the engagement section 252 can comprise an interlock portion that when engaged with the transmission component 204 prevents relative rotation therebetween, e.g., by configuring a passage of the engagement section 252 as one of a variety of polygonal shapes that can mate with a corresponding polygonal shape of the transmission component 204.

Further, the handle 202 can comprise a cylindrical slot or groove 254 disposed on a rear portion of the handle 202. As discussed below, the groove 254 can be used to align the handle 202 with the slider component 206 in order to align the assembly 200 with the support pole 102. The improved alignment of the assembly 200 with the support pole 102 can enhance frictional engagement therebetween.

Additionally, the handle 202 can be configured with one or more gripping surfaces that facilitates grasping and turning of the handle 202 by the user. Further, although it is contemplated that the handle 202 can be used in several embodiments to rotate the transmission component 204, it is also contemplated that the assembly 200 could be configured such that the handle 202 allows the user to provide a generally translational and/or linear actuation force to the transmission component 204.

Figure 5B:
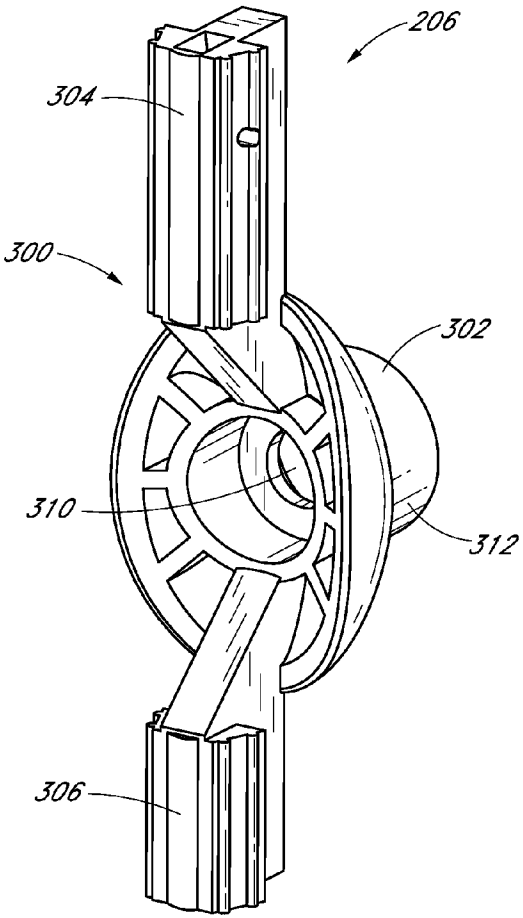
FIG. 5B is a rear perspective view of the slider component shown in FIG. 5A.
Figure 5A:
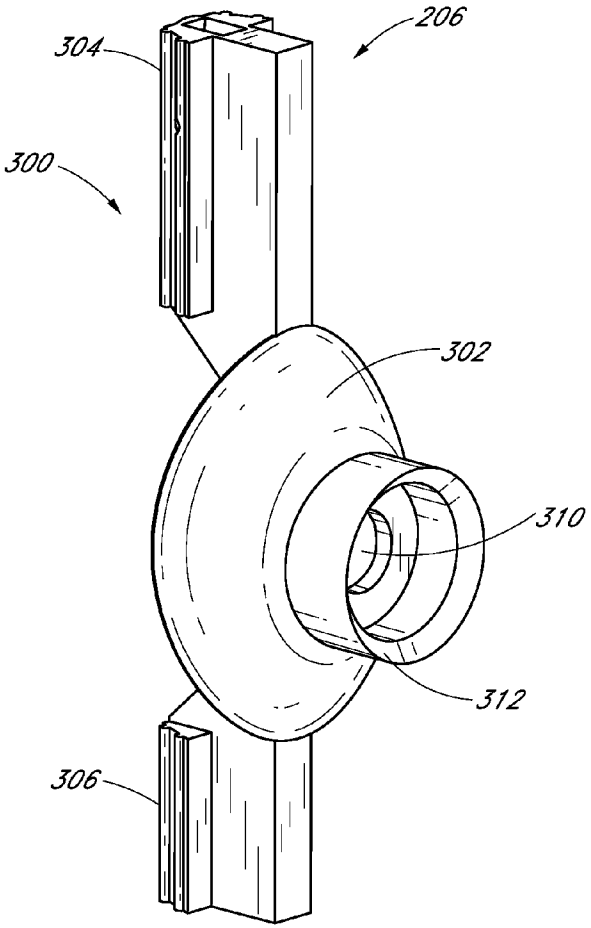
FIG. 5A is a front perspective view of a slider component of the handle assembly, according to an embodiment.

FIGS. 5A-B illustrate the slider component 206 of the assembly 200. The slider component 206 can comprise a longitudinal backbone 300 that is interconnected with a handle support portion 302. Although the slider component 206 can be used in some embodiments to facilitate alignment and operation of the assembly 200, it is also contemplated that embodiments of the assembly 200 can be implemented without a separate slider component. One of the advantages of the slider component 206 is that the slider component 206 can facilitate axial or longitudinal movement of the assembly 200 along the umbrella support pole 102. Other advantages can comprise providing a structure onto which the handle 202, the transmission component 204, the brake component 208, and the wedge component 210 can be mounted. This structure can be generally stationary relative to other components of the assembly 200. In this regard, the slider component 206 can tend to improve the stability, alignment, and durability of the assembly 200.

In an embodiment, the backbone 300 of the slider component 206 can comprise an upper slider 304 and a lower slider 306. The upper and lower sliders 304, 306 can be configured to be generally elongate components. In some embodiments, the upper and lower sliders 304, 306 can be received within an interior of the umbrella support pole 102. For example, the upper and lower sliders 304, 306 can be configured to fit within the recess 112 of the pole 102.

Further, in some embodiments, the upper and lower sliders 304, 306 can be configured to be disposed adjacent to the handle 202 and the transmission component 204. For example, the transmission component 204 can be configured to be supported by a portion of the slider component 206. In this regard, the handle support component 302 can comprise a central aperture 310 configured to receive at least a portion of the transmission component 204.

Furthermore, the handle support portion 302 can comprise a handle alignment portion 312 that extends from the support portion 302. The handle alignment portion 312 can define a generally cylindrical or tubular shape that can be at least partially received within the cylindrical slot or groove 254 of the handle 202. Thus, the handle 202 can be supported on the handle alignment portion 312. Additionally, the handle alignment portion 312 can serve to align the handle 202 with the slider component 206, and therefore, with the support pole 102. When the assembly 200 is disengaged, this beneficial feature can serve to minimize drag or sliding contact between the assembly 200 and the support pole 102 when moving the assembly 200 along the support pole 102 during opening and closing of the umbrella. Further, when the assembly 200 is engaged, this feature can also enhance frictional engagement between the assembly 200 and the support pole 102 to maintain the umbrella in an open or closed position.

Figure 6B:
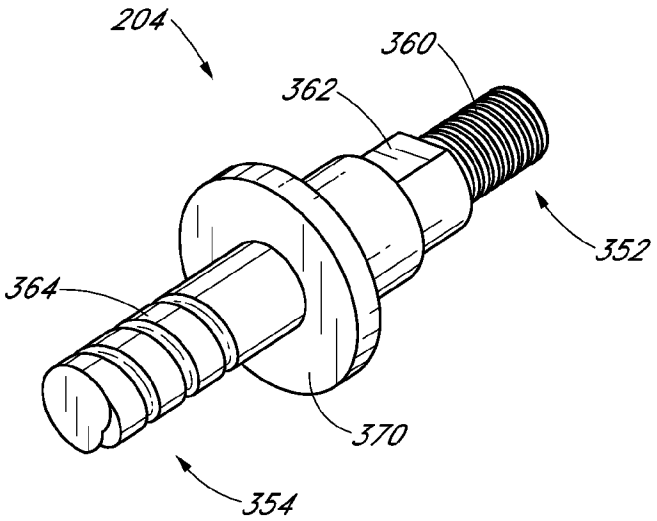
FIG. 6B is a rear perspective view of the transmission component shown in FIG. 6A.
Figure 6A:
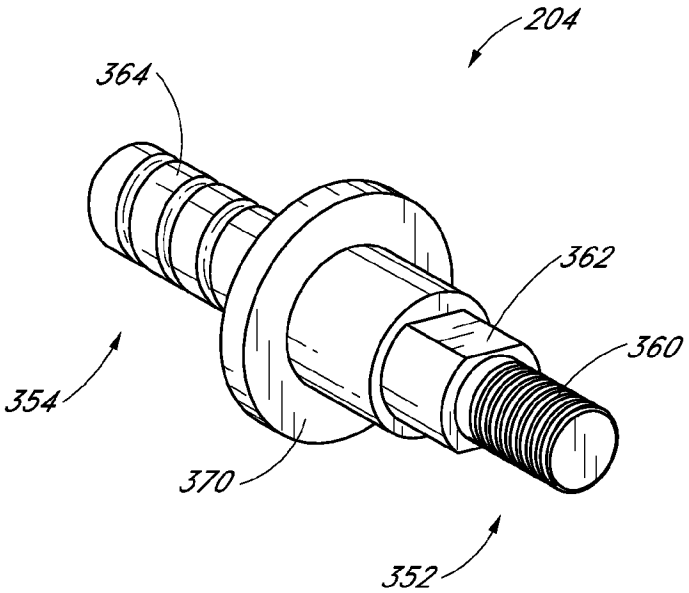
FIG. 6A is a front perspective view of a transmission component of the handle assembly, according to an embodiment.

With reference to FIG. 6A-B, an embodiment of the transmission component 204 of the handle assembly 200 is shown. The transmission component 204 can define a proximal end 352 and a distal end 354. In an embodiment, the transmission component 204 can be configured to be disposed through the central aperture 310 of the slider component 206. Further, the transmission component 204 can be configured as a generally elongate shaft having an engagement structure at each of the proximal and distal ends 352, 354.

For example, the transmission component 204 can comprise a plurality of threads 360 disposed along the proximal end 352 thereof. The threads 360 can be used to facilitate engagement with the handle 202. However, other engagement structures can also be used to provide such an engagement. For example, a press fit or interference fit can be used between the handle 202 and the proximal end 352 of the transmission component 204.

Additionally, the transmission component 204 can comprise an anti-rotational coupling 362. In this regard, when the handle 202 is coupled to the transmission component 204, the engagement section 252 of the handle 202 can fit onto the anti-rotational coupling 362 such that rotation of the handle 202 relative to the transmission component 204 is prevented. In this regard, it is contemplated that as shown in FIG. 2, a nut or other mechanical fastener can be attached to the proximal end 352 of the transmission component 204 after the handle 202 is passed and seated onto the transmission component 204. Thus, rotation and axial movement of the handle 202 relative to the transmission component 204 can be prevented.

Further, the transmission component 204 can also comprise a threaded section 364 disposed on the distal end 354 thereof. The threaded section 364 of the transmission component 204 can be configured to engage with the wedge component 210. As shown in FIGS. 3A-B and 10A-B, when the assembly 200 is assembled with the support pole 102, a longitudinal axis of the wedge component 210 can be aligned with a longitudinal axis of the support pole 102. In particular, the axial alignment of the wedge component 210 can be maintained generally constant and parallel to the longitudinal axis of the support pole 102. For example, the wedge component 210 can be at least partially received within a wedge recess of the brake component 208. In this regard, when the assembly 200 is assembled with the support pole 102, a longitudinal axis of the brake component 208 can be aligned with a longitudinal axis of the support pole 102. Thus, because the wedge component 210 is received within the wedge recess of the brake component 208, the wedge component 210 can be generally prevented from substantial rotation with respect to the support pole 102.

In such embodiments, the threaded section 364 of the transmission component 204 can be configured to threadingly engage the wedge component 210. As a result of the generally fixed rotational orientation of the wedge component 210 and the threaded engagement between the wedge component 210 and the transmission component 204, rotation of the transmission component 204 relative to the wedge component 210 can cause the wedge component 210 to move relative to a longitudinal axis of the transmission component 204. Thus, as described herein, as the handle component 202 is rotated, the transmission component 204 also rotates, and as a result of the interaction between the threaded section 564 and corresponding threads formed on the wedge component 210, the wedge component 210 can move toward or away from the handle component 202. For example, in some embodiments, the wedge component 210 can be moved in or out of the wedge recess of the brake component 208 by rotation of the handle component 202.

Figure 9:
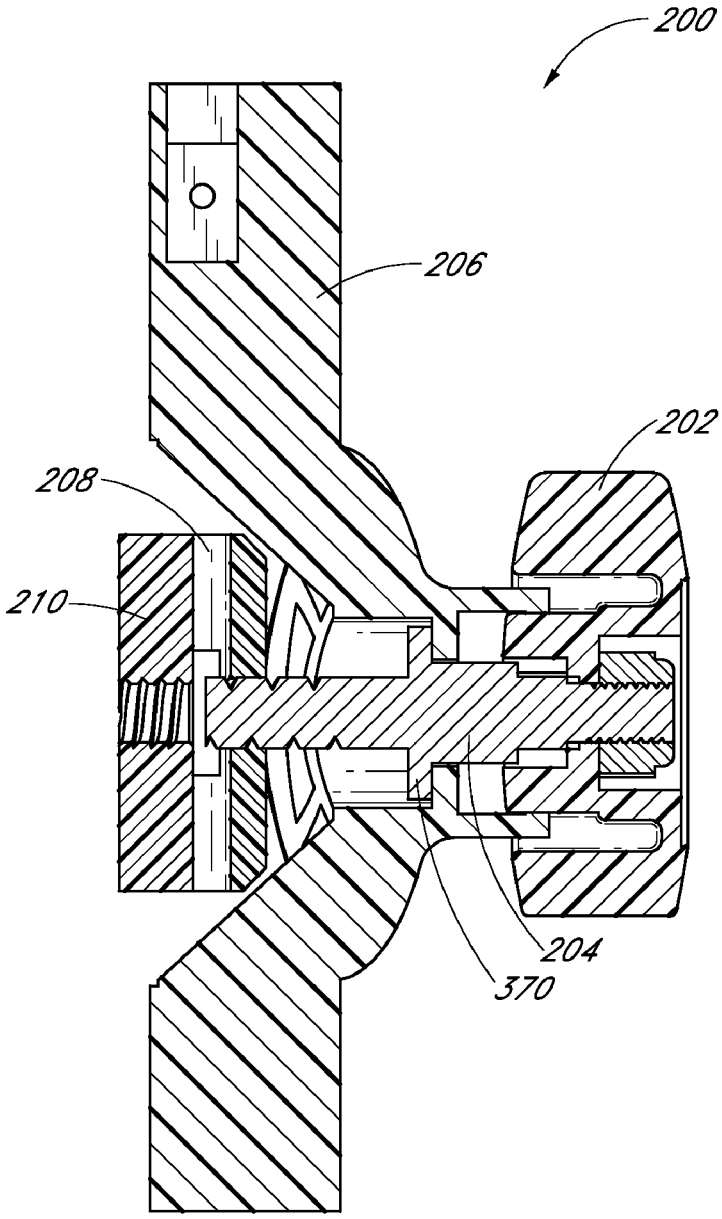
FIG. 9 is a cross-sectional side view of the handle assembly, taken along lines 9-9 of FIG. 3A.

FIGS. 6A-B also illustrate that the transmission component 204 can also comprise a flange 370. The flange 370 can be configured to abut against the slider component 206, for example. In such an embodiment, because the slider component 206 has a generally stable or fixed radial position relative to the support pole 102 (e.g., the distance of the slider component 206 from the central longitudinal axis of the pole 102), the transmission component 204 can also have a generally stable or fixed radial position relative to the support pole 102. In other words, although the transmission component 204 may rotate, the transmission component 204 will not tend to move in an axial direction along its own axis, thus toward or away from the longitudinal axis of the pole 102. Such movement can be constrained due to the abutment of the flange 370 against the slider component 370, as illustrated in FIG. 9.

Figure 7B:
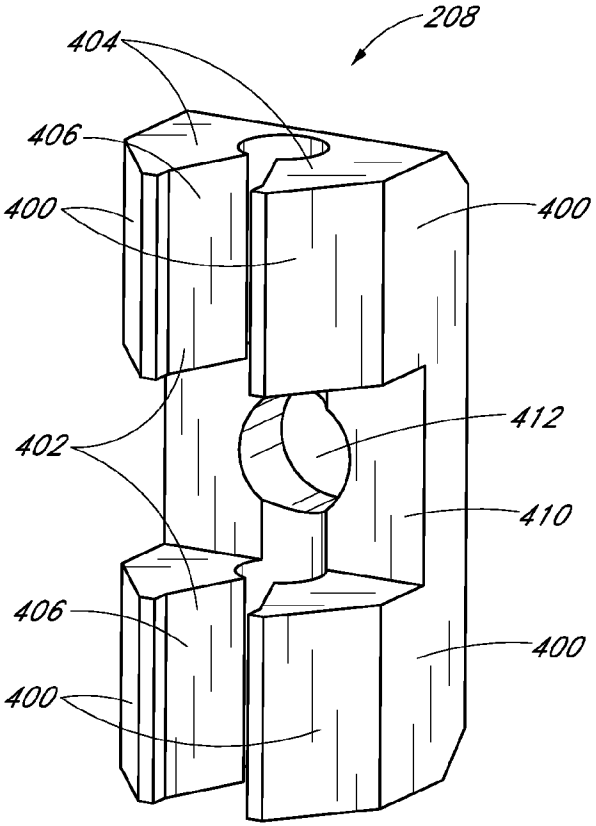
FIG. 7B is a rear perspective view of the brake component shown in FIG. 7A.
Figure 7A:
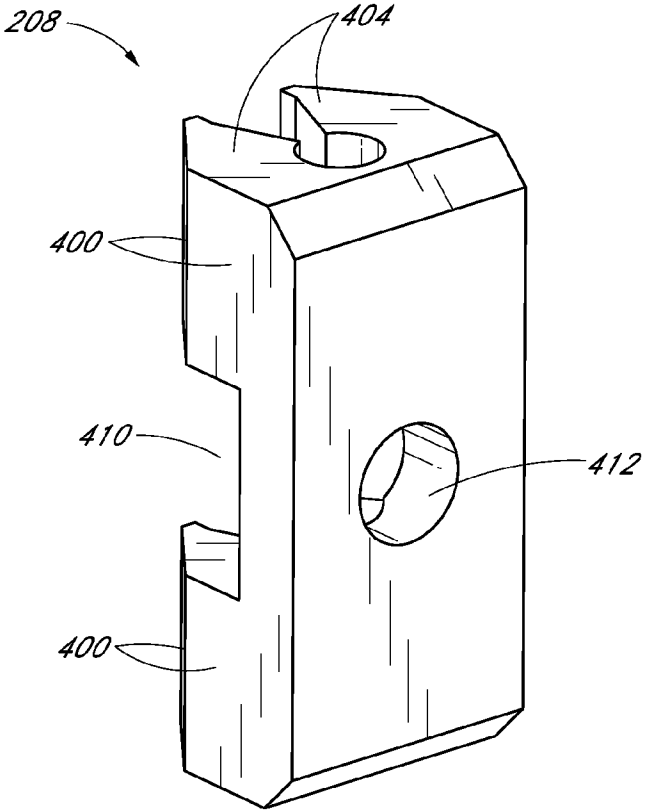
FIG. 7A is a front perspective view of a brake component of the handle assembly, according to an embodiment.

With reference now to FIG. 7A-B, an embodiment of the brake component 208 of the handle assembly 200 is shown. As noted above, the brake component 208 of the assembly 200 can be actuated to contact a surface of the umbrella support pole 102 for frictionally engaging the pole 102 in order to maintain an axial or longitudinal position of the assembly 200. In some embodiments, the brake component 208 can be positioned within a recess or interior portion of the support pole 102. In other embodiments, the brake component 208 can be positioned adjacent to an exterior surface of the pole 102.

In the embodiment illustrated in FIGS. 7A-B, the brake component 208 can comprise one or more engagement surfaces 400. As shown, in some embodiments, the surfaces 400 can be generally smooth and/or planar. However, it is contemplated that the surfaces 400 can comprise ridges, one or more protrusions, etc. in order to enhance frictional engagement with the pole 102. The engagement surfaces 400 can be configured to frictionally engage the support pole 102 when the brake component 208 is actuated. Further, the brake component 208 can comprise a wedge recess 402. The wedge recess 402 can be configured to accommodate at least a portion of the wedge component 210, such that the wedge component 210 can contact and actuate the brake component 208.

For example, the wedge recess 402 can be disposed lengthwise along the brake component 208. In some embodiments, the wedge recess 402 can be disposed intermediate a pair of deflectable shoulders 404. In some embodiments, the shoulders 404 can be connected by a flexible bridge portion of the brake component 208. The shoulders 404 can be configured to flexibly and resiliently or elastically deflect when the wedge component 210 is drawn further into the wedge recess 402. In this regard, the wedge recess 402 and the wedge component 210 can be configured such that as the wedge component 210 is actuated by rotation of the transmission component 204, the wedge component 210 contacts one or more contact surfaces 406 of the shoulders 404 and forces the shoulders 404 apart, such that the engagement surfaces 400 are urged outwardly. The contact surfaces 406 can be in sliding engagement with the wedge component 210.

In this regard, the brake component 208 can be forced from a contracted position into an expanded position. In one embodiment, the contracted position corresponds to a free state configuration, and the expanded position corresponds to an elastically deformed configuration. When the brake component 208 is in the contracted position (FIG. 10A), the assembly 200 can move freely up and down the pole 102. However, when the brake component 208 is actuated to the expanded position (FIG. 10B), the engagement surfaces 400 thereof frictionally engage the support pole 102, thereby generally fixing the longitudinal position of the assembly 200.

Additionally, in some embodiments, the brake component 208 can optionally comprise an interlock structure 410. The interlock structure 410 can be used to assist in maintaining a rotational and axial position of the wedge component 210 relative to the brake component 208. Further, in some embodiments, the interlock structure 410 can also aid in maintaining an axial position of brake component 208 relative to the transmission component 204. More specifically, the interlock structure 410 can aid in maintaining the alignment between a longitudinal axis of the pole 102 and a longitudinal axis of the brake component 208. This feature can served to reduce and/or eliminate contact between the pole 102 and the brake component 208 when the assembly 200 is being moved up and down the pole.

In some embodiments, the interlock structure 410 can comprise a recess that is configured to receive a corresponding structure of the wedge component 210. Thus, as shown in FIG. 3B, the brake component 208 and the wedge component 210 can be nested due to the engagement between the interlock structure 410 and the corresponding structure of the wedge component 210. In this regard, some embodiments can be configured such that the brake component 208 is generally aligned with the longitudinal axis of the pole 102, and therefore, serves to aid the wedge component 210 in maintaining its axial alignment with the pole 102.

Furthermore, the brake component 208 can comprise an aperture 412 through which the transmission component 204 can be disposed. In some embodiments, the aperture 412 can have a much larger diameter or interior profile than the exterior profile or diameter of the transmission component 204. However, it is also contemplated that the aperture 412 can define an interior diameter that closely mates with a diameter of the transmission component 204 to allow brake component 208 to be at least partially supported by the transmission component 204.

Figure 8B:
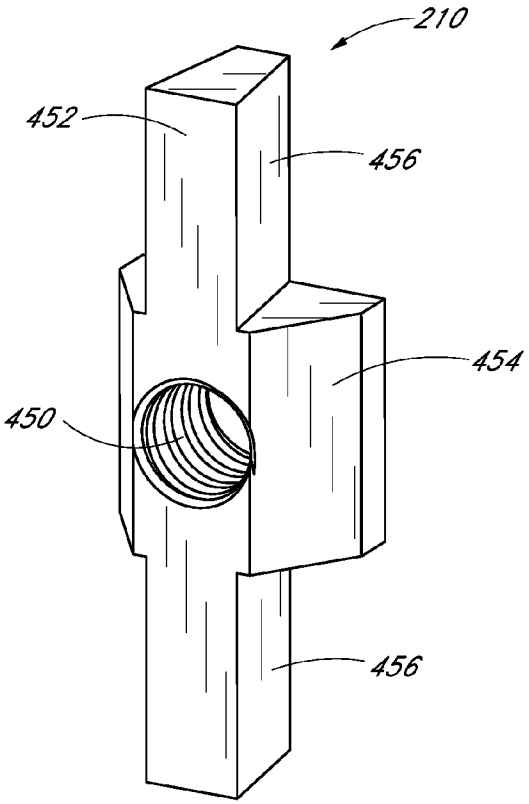
FIG. 8B is a rear perspective view of the wedge component shown in FIG. 8A.
Figure 8A:
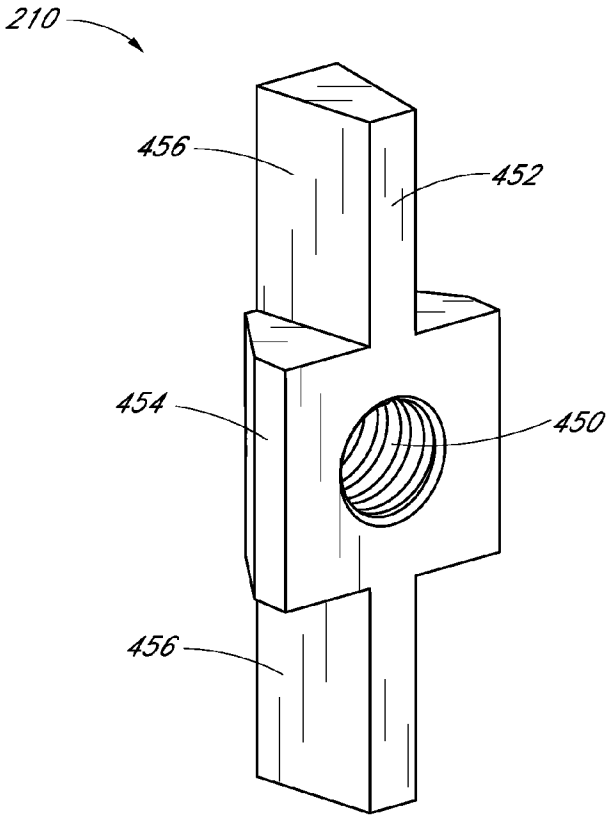
FIG. 8A is a front perspective view of a wedge component of the handle assembly, according to an embodiment.

FIGS. 8A-B illustrate an embodiment of the wedge component 210 of the handle assembly 200. The wedge component 210 can comprise a central aperture 450 that passes through a wedge-shaped body 452. As noted above, the aperture 450 can interact with the transmission component 204 to cause the wedge component 210 to move along the longitudinal axis of the transmission component 204. Accordingly, it is contemplated that the aperture 450 can comprise a threaded structure to permit rotational movement of the transmission component 204 relative to the wedge component 210 to induce movement of the wedge component 210 along an axis of the transmission component 204.

Figure 10B:
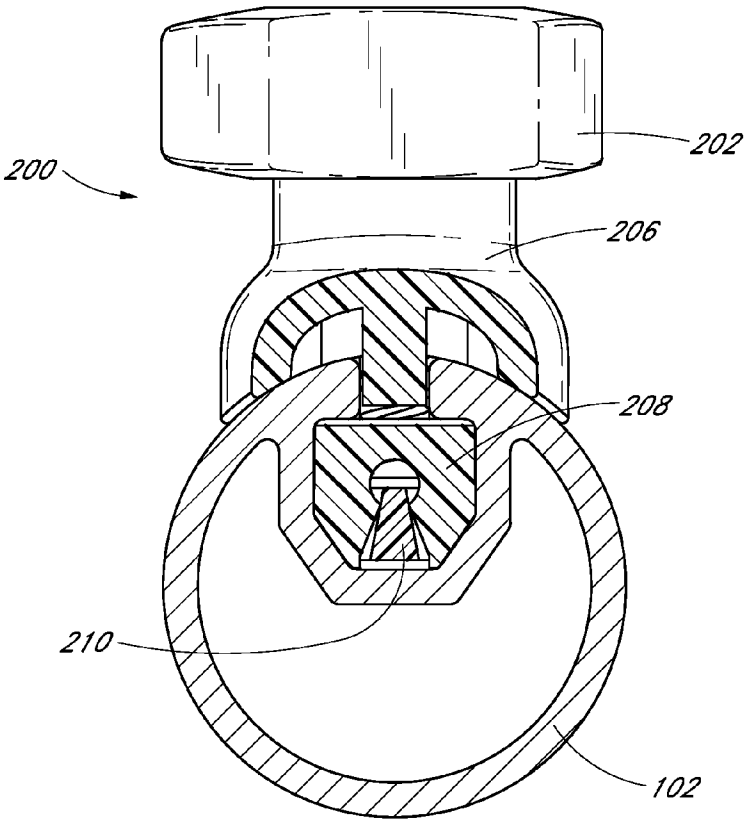
FIG. 10B is a cross-sectional top view of the handle assembly, as in FIG. 10A, wherein the handle assembly is in an engaged position.
Figure 10A:
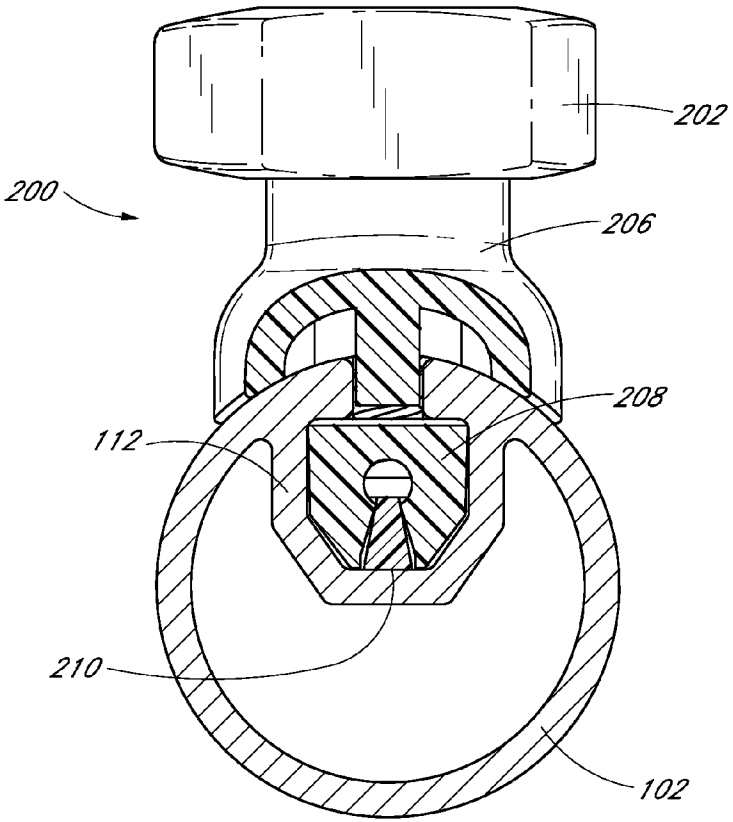
FIG. 10A is a cross-sectional top view of the handle assembly, taken along lines 10A-10A of FIG. 3A, wherein the handle assembly is in a disengaged position.

In such embodiments, when the wedge component 210 is moved along the axis of the transmission component 204, the wedge-shaped body 452 of the wedge component 210 can be drawn into or out of the wedge recess 402 of the brake component 208. The wedge component 210 can comprise contact surfaces 456. As the wedge component 210 is moved in the wedge recess 402, the shoulders 404 of the brake component 208 can be urged apart or allowed to move together due to movement of the contact surfaces 456 of the wedge component 210 against the contact surfaces 406 of the brake component 208. As such, the brake component 208 can be actuated toward the contracted position or the expanded position. Actuating toward the contracted position can include moving the wedge-shaped body 452 away from the handle 202, in a direction out of the recess 402, or away from the contact surfaces 406 of the recess 402. In one embodiment, the brake component 208 moves to the contracted position by elastically returning to a free state upon movement of the wedge-shaped body 452 away from the brake component 208. In this regard, FIG. 10A illustrates the contracted or disengaged position of the brake component 208, whereas FIG. 10B illustrates the expanded or engaged position of the brake component 208.

Further, the wedge component 210 can comprise an alignment structure 454. As noted above the structure 454 can interact with the interlock recess 410 of the brake component 208 to aid in maintaining alignment and axial position of the brake component 208 and/or the wedge component 210. Indeed, in some embodiments, the use of the interlock structure 410 and the alignment structure 454 can be very advantageous. For example, these structures benefit both the brake component 208 and the wedge component 210, as discussed above. In particular, these structures can aid in maintaining an axial alignment of the brake component 208 with the axis of the pole 102 and with the wedge component 210. Further, these structures can also aid in maintaining an axial alignment of the wedge component 210 with the pole 102.

In some embodiments, the assembly 200 can be configured such that alignment of the various components are maintained indirectly by other components to ensure that the brake component 208 does not tend to catch, engage, or make movement of the assembly 200 difficult when the brake component 208 is disengaged and the assembly 200 is being moved to open or close the umbrella. The unique configurations of such embodiments allows the components to support and maintain axial alignment of each other.

For example, in an embodiment, the handle alignment portion 312 of the slider component 206 can be inserted into the groove 254 of the handle 202. Thus, the slider component 206, which is aligned with the longitudinal axis of the pole 102, can support and maintain the alignment of the handle 202. In turn, the handle 202 can be attached to and support the transmission component 205. Further, the transmission component 204 can be attached to and support the wedge component 210. Furthermore, the wedge component 210 can be positioned adjacent to and nested with the brake component 208. As such, the slider component 206 can maintain alignment of the handle 202, which aids in maintaining the alignment of the transmission component 204, which aids in maintaining the alignment of the wedge component 210, which in turn aids in maintaining the alignment of the brake component 208.

As a result, the alignment of the brake component 208 and the wedge component 210 with the support pole 102 can also be maintained, and unnecessary drag, engagement, or contact between the brake component 208 and the pole 102 can be minimized when the assembly 200 is moved along the pole when the brake component 208 is in the contracted position (or other disengaged configuration). On the other hand, the superior alignment of these components also aids in maximizing frictional engagement between the engagement surfaces 400 of the brake component 208 and the pole 102.

Accordingly, as the assembly 200 moves up and down the support pole 102, the alignment of the assembly 200 and the support pole 102 can be maintained. Thus, the assembly 200 can be configured such that the when aligned, the brake component 208 of the assembly 200 does not tend to make contact with, and therefore create drag with or against the support pole 102 as the assembly 200 moves during opening and closing of the umbrella. Further, when the assembly 200 is actuated to frictionally engage with the support pole 102, the frictional engagement between the engagement surfaces of the can be maximized due to enhanced alignment between the brake component 208 and the pole 102.

FIGS. 9-10B illustrate an assembled configuration of the umbrella pole 102 and the assembly 200. In addition, FIG. 10A illustrates the contracted or disengaged position of the brake component 208, whereas FIG. 10B illustrates the expanded or engaged position of the brake component 208. As shown in these figures, in the contracted or disengaged position, there can be clearance between the engagement surfaces 400 of the brake component 208 and the interior surfaces of the cavity or recess 112 of the pole 102. Further, when the brake component 208 is in the expanded position, the engagement surfaces 400 thereof can frictionally engage the interior surfaces of the recess 112 of the pole 102.

Additionally, the expansion of the brake component 208 provides not only frictional engagement with the pole 102, but some embodiments can also be expanded or deflected such that at least one dimension of the assembly 200 increases to a maximum allowable by at least one dimension of the recess 112 of the pole 102. For example, in FIG. 10B, the wedge component 210 can be drawn into the wedge recess to cause the brake component 208 to deflect, thereby increasing the width of the brake component 208. The recess 112 of the pole 102 can be configured sufficiently wider than the brake component 208 to allow movement of the brake component 208 therein when in the contracted position, but also narrow enough such that the widening of the brake component 208 in response to the actuation of the wedge component 210 causes the width of the brake component 208 to expand to a maximum width allowable within the recess 208. Thus, such an increase in the width of the brake component 208 would tend to engage the handle assembly 200 with the pole 102.

Further, it is contemplated that continued actuation of the wedge component 210 can produce progressively more friction between the engagement surfaces 400 and the structure of the pole 102 surrounding the recess 112. For example, in some embodiments, the brake component 208 can comprise a compressible material to allow the operator to continue actuating the wedge component 210 to cause additional portions of the brake component 208 to be compressed against the pole 102 with additional actuation.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella handle assembly for maintaining a position of a canopy relative to a support pole of an umbrella, the umbrella handle assembly being slidably disposed on the support pole, the umbrella handle assembly comprising:

a handle component having a grip portion and a connector portion, the handle component being configured to transfer motion of the grip portion to the connector portion;

a transmission component having a first end and a second end, the first end being coupled to the connector portion of the handle component, the second end configured to extend at least partially through a perimeter of the support pole;

a brake component having at least one contact surface and at least one engagement surface, the brake component being moveable in a direction transverse to an axis of the transmission component, the engagement surface of the brake component being configured to contact an engagement surface of the support pole; and a wedge component having at least one contact surface being slidably positioned against the contact surface of the brake component, the wedge component being interconnected with the transmission component such that movement of the transmission component causes the wedge component to move relative to the brake component, the movement of the wedge component causing movement of the brake component in a direction transverse to a direction of movement of the wedge component such that the engagement surface of the brake component engages or disengages with the engagement surface of the support pole.

2. The umbrella handle assembly of claim 1, wherein the brake component comprises a pair of contact surfaces for slidably contacting a pair of contact surfaces of the wedge component.

3. The umbrella handle assembly of claim 2, wherein the pair of contact surfaces of the brake component are configured in a wedge formation and wherein the pair of contact surfaces of the wedge component slidably contact the contact surfaces of the brake component.

4. The umbrella handle assembly of claim 1, wherein the transmission component comprises an elongate shaft having a threaded portion adjacent to the second end thereof, the threaded portion being threadably coupled to the wedge component such that rotation of the transmission component causes translation of the contact surface of the wedge component against the contact surface of the brake component.

5. The umbrella handle assembly of claim 4, wherein rotation of the handle component causes the wedge component to be drawn toward the first end of the transmission component.

6. The umbrella handle assembly of claim 1, wherein the brake component defines a wedge-shaped recess defined at least partially by a pair of opposing contact surfaces, the wedge component being slidably disposed within the recess of the brake component with a pair of contact surfaces contacting a respective one of the opposing contact surfaces, wherein movement of the handle portion causes the wedge component to move within the wedge-shaped recess to cause the brake component to engage or disengage with the engagement surface of the support pole.

7. The umbrella handle assembly of claim 6, wherein the wedge-shaped recess of the brake component extends generally parallel to a longitudinal axis of the support pole.

8. The umbrella handle assembly of claim 1, wherein the direction of movement of the wedge component is linear.

9. The umbrella handle assembly of claim 1, wherein the direction of movement of the wedge component is generally perpendicular relative to a longitudinal axis of the support pole.

10. The umbrella handle assembly of claim 1, wherein the brake component comprises a plurality of engagement surfaces.

11. The umbrella handle assembly of claim 1, wherein the brake component comprises a pair of shoulders that move apart from each other upon contact by the wedge component.

12. The umbrella handle assembly of claim 11, wherein the shoulders of the brake component move apart from each other upon contact by the wedge component.

13. The umbrella handle assembly of claim 1, wherein the brake component comprises a body having a generally U-shaped cross-section that comprises a pair of shoulders coupled together, the shoulders being spreadable relative to each other.

14. The umbrella handle assembly of claim 13, wherein the shoulders each comprise contact surfaces for contacting a pair of contact surfaces of the wedge component and engagement surfaces.

15. The umbrella handle assembly of claim 14, wherein a movement of the wedge component within the brake component causes the shoulders of the brake component to separate and contact the engagement surfaces of the support pole.

16. The umbrella handle assembly of claim 15, wherein the contact surfaces of the shoulder and of the wedge component are oriented in a generally V-shaped configuration.

17. The umbrella handle assembly of claim 1, wherein the brake component is moveable in a direction transverse to a longitudinal axis of the support pole.

18. The umbrella handle assembly of claim 17, wherein the axis of the brake component extends generally vertically.

19. An umbrella handle assembly for maintaining a position of a canopy relative to a support pole of an umbrella, the umbrella handle assembly being slidably disposed on the support pole, the umbrella handle assembly comprising a brake component, a wedge component, and a handle component, the brake component being disposed within the support pole and comprising a pair of shoulders, the handle component being interconnected with the wedge component for drawing the wedge component into a wedge-shaped recess of the brake component to cause at least corresponding portions of the shoulders of the brake component to move apart from each other toward the engagement surface of the support pole to engage with an engagement surface of the support pole to thereby secure the umbrella handle assembly relative to the support pole.

20. The umbrella handle assembly of claim 19, wherein the wedge-shaped recess of the brake component extends generally parallel to a longitudinal axis of the support pole.

21. The umbrella handle assembly of claim 19, further comprising a transmission component interconnecting the handle component with the wedge component, the transmission component comprising an elongate shaft having a threaded portion that is threadably coupled to the wedge component such that rotation of the transmission component causes translation of the wedge component within the recess of the brake component.

22. The umbrella handle assembly of claim 21, wherein rotation of the handle component causes the wedge component to be drawn toward the first end of the transmission component.

23. The umbrella handle assembly of claim 19, wherein the wedge component is configured to move in a first direction upon actuation by the handle component and wherein the movement of the wedge component causes the brake component to move in a direction transverse to the first direction.

24. The umbrella handle assembly of claim 23, wherein the first direction is linear.

25. The umbrella handle assembly of claim 24, wherein the first direction is generally perpendicular relative to a longitudinal axis of the support pole.

26. The umbrella handle assembly of claim 19, wherein the shoulders of the brake component move apart from each other upon contact by the wedge component.

27. The umbrella handle assembly of claim 19, wherein the brake component comprises a body having a generally U-shaped cross-section that comprises a pair of shoulders being coupled to each other.

28. The umbrella handle assembly of claim 27, wherein the shoulders each comprise contact surfaces for contacting a pair of contact surfaces of the wedge component and engagement surfaces.

29. The umbrella handle assembly of claim 28, wherein movement of the wedge component within the brake component causes the shoulders of the brake component to move angularly apart from each other and contact the engagement surface of the support pole.

30. The umbrella handle assembly of claim 28, wherein the contact surfaces of the shoulder and of the wedge component are oriented in a generally V-shaped configuration.

31. An umbrella handle assembly for maintaining a position of a canopy relative to a support pole of an umbrella, the umbrella handle assembly being slidably disposed on the support pole, the umbrella handle assembly comprising an expandable brake component, a wedge component, and a handle component, the expandable brake component being disposed within an internal channel of the support pole, the handle component being interconnected with the wedge component for actuating the wedge component in a recess of the brake component to cause the brake component to expand outwardly in a direction transverse to a direction of movement of the wedge component within the channel of the pole to engage with an engagement surface of the support pole to thereby secure the umbrella handle assembly relative to the support pole.

32. The umbrella handle assembly of claim 31, wherein movement of the wedge component within the brake component causes shoulders of the brake component to spread apart from each other to contact the engagement surface of the support pole.

33. The umbrella handle assembly of claim 32, wherein movement of the wedge component within the brake component causes shoulders of the brake component to move apart from each other to contact the engagement surface of the support pole.

34. The umbrella handle assembly of claim 31, wherein the brake component comprises a pair of contact surfaces that are configured in a wedge formation, and wherein the wedge component comprises a pair of contact surfaces that slidably contact the contact surfaces of the brake component to cause expansion of the brake component.

35. An umbrella handle assembly for maintaining a position of a canopy relative to a support pole of an umbrella, the umbrella handle assembly being slidably disposed on the support pole, the umbrella handle assembly comprising a brake component, a wedge component, and a handle component, the brake component being disposed within an internal channel of the support pole, the handle component being interconnected with the wedge component for enhancing engagement between the wedge component and the brake component to provide a braking force between the brake component and an engagement surface of the support pole in a direction transverse to a direction of movement of the wedge component to thereby secure the umbrella handle assembly relative to the support pole.

36. The umbrella handle assembly of claim 35, wherein the brake component moves in response to contact with the wedge component.

37. The umbrella handle assembly of claim 36, wherein the brake component expands in response to contact with the wedge component.

38. The umbrella handle assembly of claim 37, wherein the brake component comprises a pair of shoulders that expand in response to contact with the wedge component.

39. The umbrella handle assembly of claim 35, wherein the wedge component is moveable along an axis that is transverse to a longitudinal axis of the support pole.

40. The umbrella handle assembly of claim 35, wherein rotation of the handle component causes the wedge component to be drawn into contact with the brake component.

* * * * *